US009820058B2

(12) United States Patent
Pan et al.

(10) Patent No.: US 9,820,058 B2
(45) Date of Patent: Nov. 14, 2017

(54) CAPACITIVE MEMS MICROPHONE WITH INSULATING SUPPORT BETWEEN DIAPHRAGM AND BACK PLATE

(71) Applicants: Zhengmin Benjamin Pan, LA, CA (US); Zhenkui Meng, Shenzhen (CN)

(72) Inventors: Zhengmin Benjamin Pan, LA, CA (US); Zhenkui Meng, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 212 days.

(21) Appl. No.: 14/584,742

(22) Filed: Dec. 29, 2014

(65) Prior Publication Data

US 2015/0189444 A1 Jul. 2, 2015

(30) Foreign Application Priority Data

Dec. 31, 2013 (CN) ..... 2013 1 0754169

(51) Int. Cl.
*H04R 19/04* (2006.01)
*H04R 19/00* (2006.01)

(52) U.S. Cl.
CPC ..... *H04R 19/04* (2013.01); *H04R 19/005* (2013.01)

(58) Field of Classification Search
CPC ..... H04R 17/02; H04R 19/04
USPC ..... 381/173, 174
See application file for complete search history.

(56) References Cited

U.S. PATENT DOCUMENTS

| | | | | |
|---|---|---|---|---|
| 2006/0093170 | A1* | 5/2006 | Zhe et al. | 381/191 |
| 2007/0047746 | A1* | 3/2007 | Weigold | H04R 1/406 381/174 |
| 2008/0192963 | A1* | 8/2008 | Sato | 381/174 |
| 2012/0250928 | A1* | 10/2012 | Pance et al. | 381/386 |
| 2013/0177180 | A1* | 7/2013 | Bharatan et al. | 381/174 |
| 2014/0270271 | A1* | 9/2014 | Dehe et al. | 381/174 |

* cited by examiner

*Primary Examiner* — Katherine Faley
(74) *Attorney, Agent, or Firm* — Na Xu; IPro, PLLC

(57) ABSTRACT

Disclosed is MEMS microphone. The MEMS microphone includes a substrate and a capacitor system disposed on the substrate. The capacitor system has a back plate, a diaphragm, an insulating space formed by the back plate and the diaphragm and at least one insulating support disposed in the insulating space and connected with the back plate or the diaphragm. When the MEMS microphone is working, the insulating support engages with the diaphragm or the back plate thereby dividing the diaphragm into at least two vibrating units which improves the sensitivity and SNR of the MEMS microphone. Meanwhile, the MEMS microphone has the advantage of low cost and is easy to be fabricated.

12 Claims, 5 Drawing Sheets

CAPACITIVE MEMS MICROPHONE WITH INSULATING SUPPORT BETWEEN DIAPHRAGM AND BACK PLATE

FIELD OF THE INVENTION

The disclosure described herein relates generally to microphones, and more particularly, to an MEMS (Micro-Electro-Mechanical System) microphone.

DESCRIPTION OF RELATED ART

MEMS microphone is an electro-acoustic transducer fabricated by micromachining technology, which is characterized by small size, good frequency response, and low noise. With the miniaturization and thinness development of the electronic devices, the MEMS microphone is widely used in these electronic devices.

Related MEMS microphone comprises a silicon substrate and a plate capacitor comprising a diaphragm and a back plate separated from the diaphragm. The distance between the diaphragm and the back plate is changed when the diaphragm is driven to vibrate by sound waves, which changes the capacity of the plate capacitor. By this way, the MEMS microphone converts the sound waves into electrical signals.

However, the sensitivity and SNR (Signal-Noise Ratio) of the MEMS microphone will be reduced as the area of the diaphragm and the back plate increases. Under this situation, the diaphragm is also easy to be stuck to the back plate. Furthermore, the MEMS microphone having large diaphragm and back plate is also hard to be fabricated, which increases the producing cost.

Therefore, an improved MEMS microphone is provided in the present disclosure to solve the problem mentioned above.

Figure 1:
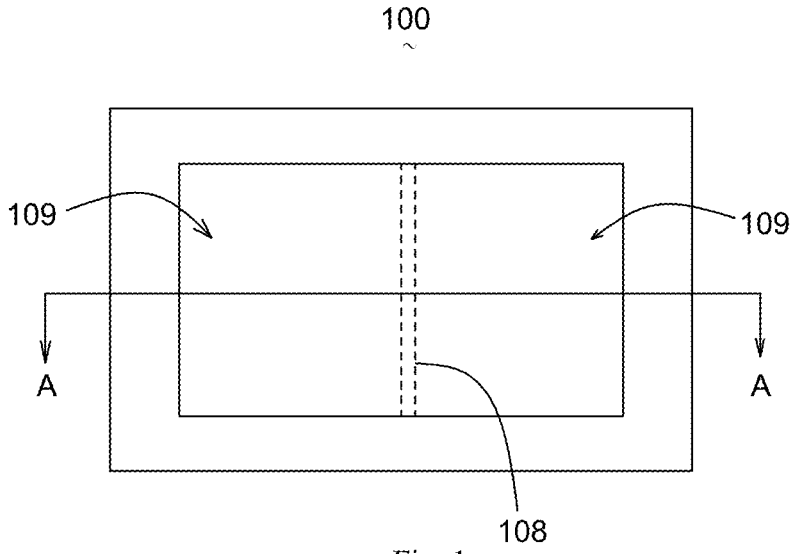
FIG. 1 illustrates a top view of a MEMS microphone in accordance with a first embodiment of the present disclosure.

Many aspects of the embodiments can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Reference will now be made to describe the embodiments of the present invention in detail.

Figure 2:
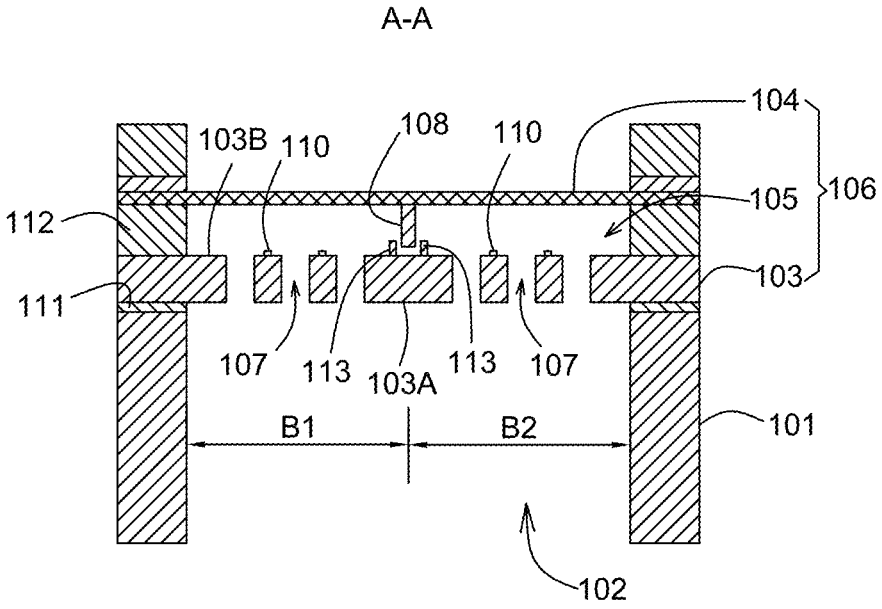
FIG. 2 illustrates a cross-sectional view of the MEMS microphone taken along line A-A in FIG. 1.
Figure 3:
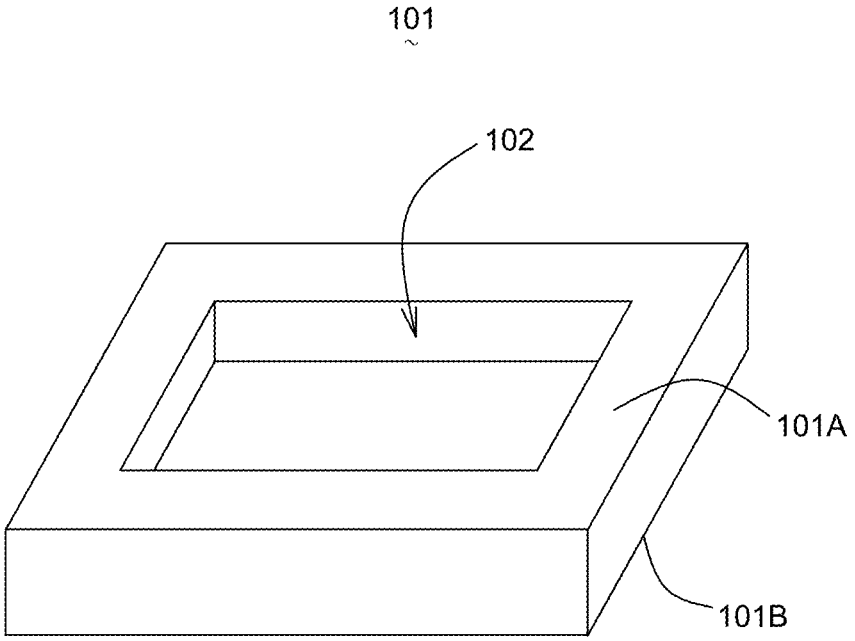
FIG. 3 is an isometric view of a back plate of the MEMS microphone in FIG. 1.

Referring to FIGS. 1-3, the present disclosure provides a MEMS microphone 100 of the first embodiment comprising a substrate 101 and a capacitor system 106 disposed on the substrate 101 and insulated from the substrate 101. The substrate 101 is made from semiconductor material, like silicon, and has a back cavity 102, an upper surface 101A, a lower surface 101B opposite to the upper surface 101A and an insulating layer 111 on the upper surface 101A. The back cavity 102 could be formed in the substrate 101 by dry etching or bulk silicon processing. The back cavity 102 drills completely through the substrate 101 and the insulating layer 111.

The capacitor system 106 comprises a back plate 103, a diaphragm 104 separated from the back plate 103 and an insulating portion 112 sandwiched between the back plate 103 and the diaphragm 104 thereby forming an insulating space 105. The back plate 103 has a first surface 103A engaging with the insulating layer 111, a second surface 103B opposite to the first surface 103A, and several through holes 107 extending through the back plate 103 for leaking the sound pressure. The through holes 107 communicate with the back cavity 102 and the insulating space 105. The insulating portion 112 is disposed on the second surface 103B, and the diaphragm 104 is disposed on the insulating portion 112. The back plate 103 and the diaphragm 104 are conductor. When the diaphragm 104 is driven to vibrate by the sound waves, the distance between the diaphragm 104 and the back plate 103 is changed which changes the capacity of the capacitor system 106. By this way, the MEMS microphone 100 converts the sound waves into electric signals.

The MEMS microphone 100 further comprises an insulating support 108 connecting with the diaphragm 104 or the back plate 103. The insulating support 108 locates in the insulating space 105 and crosses the geometrical center of the diaphragm 104. That is, the insulating support 108 divides the diaphragm 104 into two parts having equal size. In this embodiment, the diaphragm 104 is rectangular. Optionally, the diaphragm 104 may be formed in other shapes. When the MEMS microphone 100 is working, the diaphragm 104 and the back plate 103 will take opposite charges, and the diaphragm 104 will move towards the back plate 103 under the action of the electrostatic force until the insulating support 108 engages with the back plate 103. At that time, the diaphragm 104 is divided into two vibrating units 109 by the insulating support 108. Referring to FIG. 2, the back plate 103 has two electrodes on the areas marked B1 and B2. The two electrodes are insulated from each other and correspond to the vibrating units 109, respectively. Each vibrating unit 109 forms a capacitor with the corresponding electrode, and the two capacitors are arranged in parallel. Under this situation, the diaphragm 104 could have only one electrode, or have two electrodes on the areas marked B1 and B2. Optionally, the diaphragm 104 could have two electrodes on the areas marked B1 and B2, correspondingly, the back plate 103 has one or two electrodes. Actually, when the MEMS microphone is working, it is divided into two independent working microphone units, by this way, the sensitivity and the SNR of the MEMS microphone 100 are improved.

It should be understood that when the MEMS microphone 100 is not working, the insulating support 108 separates from the back plate 103. Only when the MEMS microphone 100 is electrified, the insulating support 108 engages with the back plate 103 and never separates from each other. The engaging force between the insulating support 108 and the back plate 103 is controlled by the voltage applied on the diaphragm 104 and the back plate 103. Furthermore, the second surface 103B has several insulating protrusions 110 for preventing the diaphragm 104 to adhere to the back plate 103 when the diaphragm 104 vibrates towards the back plate 103. The insulating protrusions 110 should not be charged even if the MEMS microphone 100 is working. The function of the insulating protrusions 110 is preventing the diaphragm 104 to adhere to the back plate 103 which is different from the insulating support 108.

The back plate 103 further has a fitting portion 113 positioned on the surface towards the insulating space 105. The fitting portion 113 forms a fitting space together with the surface of the back plate 103 towards the insulating space 105 for receiving the insulating support 108 when the insulating support 108 engages with the back plate 103. The fitting portion 113 could be two parallel plate unit or an annular unit. It should be understood that the width of the fitting space could be slightly wider than that of the insulating support 108. The fitting space formed by the fitting portion 113 is capable of ensuring the stability of the insulating support 108.

Figure 4:
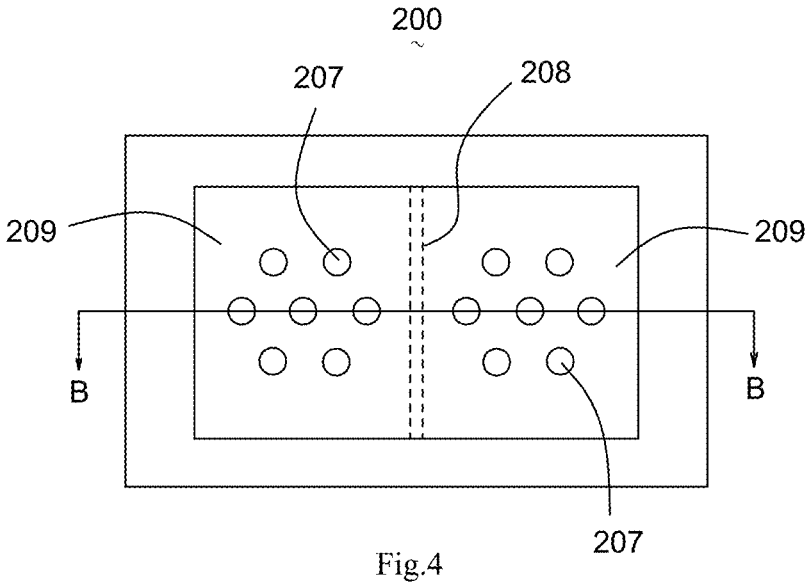
FIG. 4 is a top view of a MEMS microphone in accordance with a second embodiment of the present disclosure.
Figure 5:
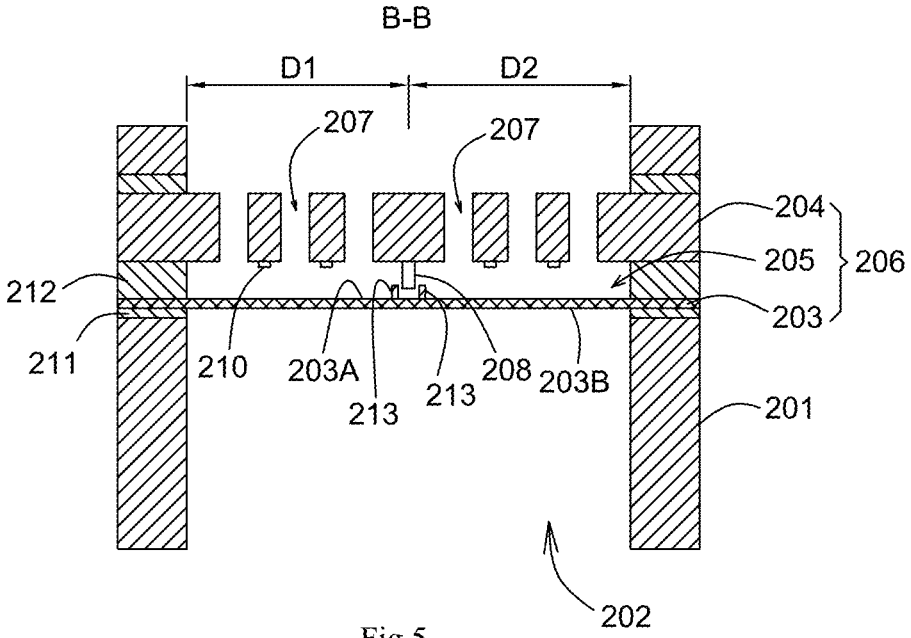
FIG. 5 is a cross-sectional view of the MEMS microphone taken along line B-B in FIG. 4.

Referring to FIGS. 4-5, the present disclosure also provides a MEMS microphone 200 of the second embodiment comprising a substrate 201 and a capacitor system 206 disposed on the substrate 201 and insulated from the substrate 201. The substrate 201 is made from semiconductor material, like silicon, and has a back cavity 202, an upper surface, a lower surface opposite to the upper surface and an insulating layer 211 covered on the upper surface. The back cavity 202 could be formed in the substrate 201 by dry etching or bulk silicon processing. The back cavity 202 drills through the substrate 201 and the insulating layer 211.

The capacitor system 206 comprises a back plate 204, a diaphragm 203 separated from the back plate 204 and an insulating portion 212 disposed between the back plate 204 and the diaphragm 203 thereby forming an insulating space 205. The back plate 204 has several through holes 207 extending through the back plate 204 for leaking the sound pressure. The through holes 207 communicate with the back cavity 202 and the insulating space 205. The diaphragm 203 has a bottom surface 203B engaging with the insulating layer 211 and a top surface 203A opposite to the bottom 203B. The insulating portion 212 is disposed on the top surface 203A and the back plate 204 is disposed on the insulating portion 212. The back plate 204 and the diaphragm 203 are conductor. When the diaphragm 203 is driven to vibrate by the sound waves, the distance between the diaphragm 203 and the back plate 204 is changed which changes the capacity of the capacitor system 106 thereby converting the sound waves into electric signals.

The MEMS microphone 200 further comprises an insulating support 208 connecting with the back plate 204. Optionally, the insulating support 208 may also be connected with the diaphragm 203. The insulating support 208 locates in the insulating space 205 and crosses the geometrical center of the back plate 204. In this embodiment, the diaphragm 203 is rectangular. Optionally, the diaphragm 203 could be formed in other shapes When the MEMS microphone 200 is electrified, the diaphragm 203 and the back plate 204 will take opposite charges, and the diaphragm 203 will move towards the back plate 204 under the action of the electrostatic force until the insulating support 208 engages with the back plate 204. Thus, the diaphragm 203 is divided into two vibrating units 209 having equal size by the insulating support 208. Referring to FIG. 5 again, the back plate 204 has two electrodes on the areas marked D1 and D2, the two electrodes are insulated from each other. Each vibrating unit 209 forms a capacitor with the correspond electrode and the two capacitors are arranged in parallel. The diaphragm 203 could have only one electrode, or have two electrodes that corresponding to the areas marked B1 and B2. Optionally, the back plate 204 may have one electrode, correspondingly, the diaphragm 203 could have two electrodes corresponding to the areas marked B1 and B2.

It should be understood that when the MEMS microphone 200 is not working, the insulating support 208 separates from the diaphragm 203. Only when the MEMS microphone 200 is working, the insulating support 208 engages with the diaphragm 203 and never separates from each other. The engaging force between the insulating support 208 and the diaphragm 203 is controlled by the voltage applied on the diaphragm 203 and the back plate 204. Furthermore, the back plate 204 has several insulating protrusions 210 mounted on the surface towards the insulating space 205, and the insulating protrusions 210 is capable of preventing the diaphragm 203 to adhere to the back plate 204 when the diaphragm 203 vibrates towards the back plate 204. The insulating protrusions 210 should not be charged even if the MEMS microphone 200 is working.

The diaphragm 203 further has a fitting portion 213 positioned on the surface towards the insulating space 205. The fitting portion 213 forms a fitting space together with the surface of the diaphragm 203 towards the insulating space 205 for receiving the insulating support 208 when the insulating support 208 engages with the back plate 204. The fitting portion 213 could be two parallel plate units or an annular unit. It should be understood that the width of the fitting space could be slightly wider than that of the insulating support 208. The fitting space formed by the fitting portion 213 is capable of ensuring the stability of the insulating support 208.

Figure 6:
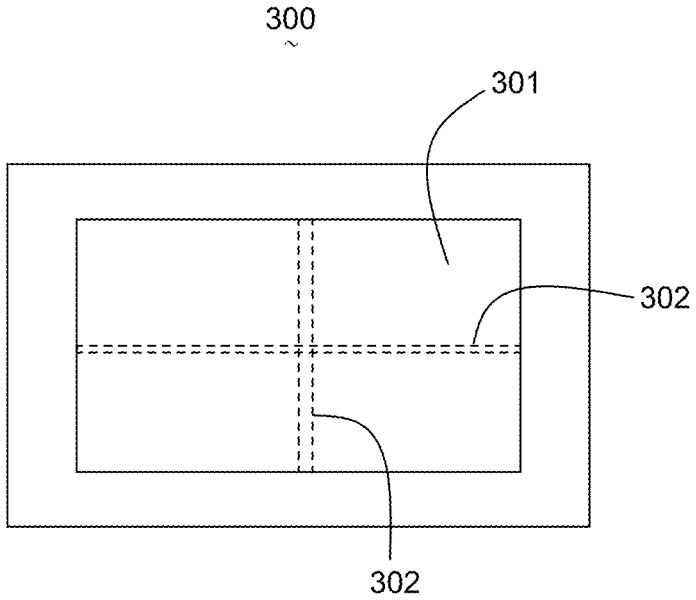
FIG. 6 is a top view of a MEMS microphone in accordance with a third embodiment of the present disclosure.

FIG. 6 shows a MEMS microphone 300 in according with a third embodiment of the present disclosure. The MEMS microphone 300 is similar to the two embodiments mentioned above except that the diaphragm or the back plate of the MEMS microphone 300 has two insulating supports 302. The two insulating supports 302 intersect with each other, and an intersection of the two insulating supports 302 is superposed with the geometric center of the diaphragm or the back plate. Optionally, the two insulating supports 302 are perpendicular to each other for dividing the diaphragm into four vibrating units 301 having equal size.

Figure 7:
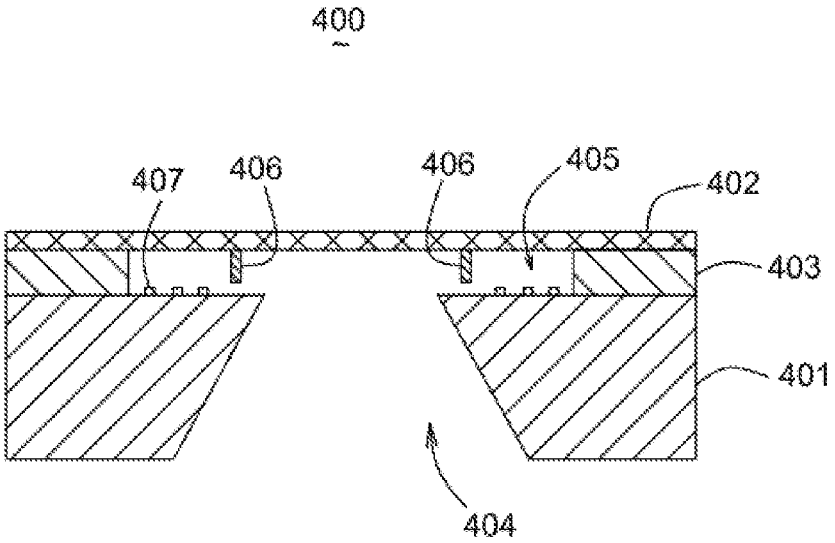
FIG. 7 is a cross-sectional view of a MEMS microphone in accordance with a fourth embodiment of the present disclosure.

FIG. 7 shows a MEMS microphone 400 in according with a fourth embodiment of the present disclosure. The MEMS microphone 400 has a conductive substrate 401, a diaphragm 402 and an insulating portion 403 disposed between the conductive substrate 401 and the diaphragm 402 thereby forming an insulating space 405. The conductive substrate 401, the diaphragm 402 and the insulating space 405 forms a capacitor system together. The conductive substrate 401 has a back cavity 404 communicating with the insulating space 405. When the diaphragm 402 is driven to vibrate by the sound waves, the distance between the diaphragm 402 and the conductive substrate 401 is changed which changes the capacitor of the capacitor system. Thus, the MEMS microphone 400 converts the sound waves into electrical signals.

In this embodiment, the MEMS microphone 400 further has two insulating supports 406 provided on the diaphragm 402 and positioned in the insulating space 405. Alternatively, the insulating support 406 may also be provided on the substrate 401, and the amount of the insulating support 406 is not limited to two and according to different desires. Optionally, the insulating support 406 may be an annual unit. The insulating supports 406 may be disposed on the conductive substrate 401. When the MEMS microphone 400 is electrified, the diaphragm 402 and the conductive substrate 401 will take opposite charges thereby forming the capacitor system and the diaphragm 402 moves towards the conductive substrate 401 under the action of the electrostatic force until the insulating supports 406 engage with the conductive substrate 401. Thus, the diaphragm 402 is divided into three vibrating units. Every single vibrating unit forms a capacitor with the conductive substrate 401 and the capacitors are in parallel.

When the MEMS microphone 400 is not working, the insulating supports 406 separate from the conductive substrate 401. Only when the MEMS microphone 400 is working, the insulating supports 406 engage with the conductive substrate 401 and never separate from each other. The engaging force between the insulating supports 406 and the conductive substrate 401 is controlled by the voltage applied on the diaphragm 402 and the conductive substrate 401. The conductive substrate 401 further has several insulating protrusions 407 on the surface towards the insulating space 405 for preventing the diaphragm 402 from adhering to the conductive substrate 401 while the diaphragm 402 is vibrating. The insulating protrusions 407 will not be charged even if the MEMS microphone 400 is working.

Figure 8:
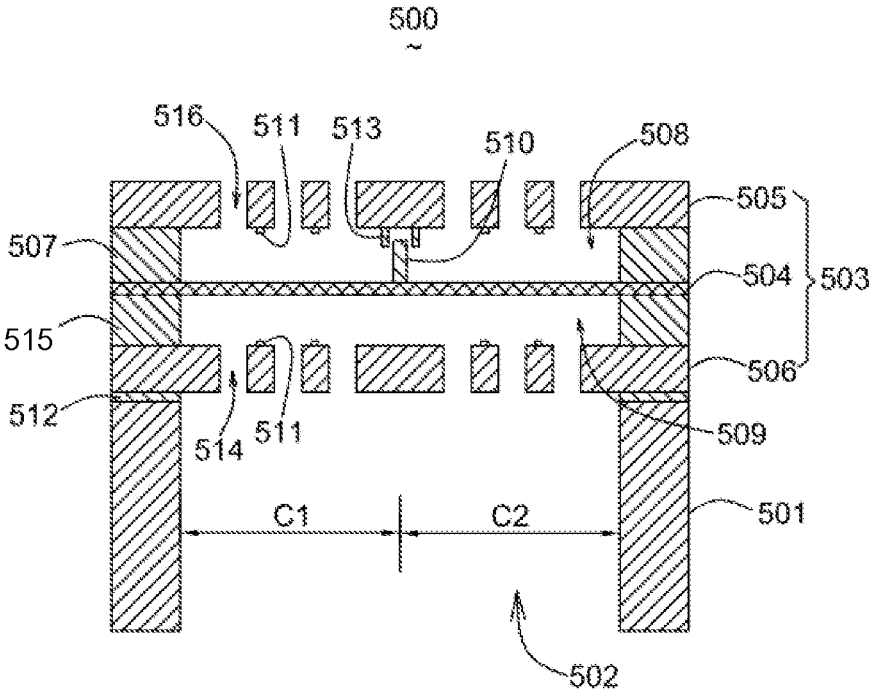
FIG. 8 is a cross-sectional view of a MEMS microphone in accordance with a fifth embodiment of the present disclosure.

FIG. 8 shows a MEMS microphone 500 in according with a fifth embodiment of the present disclosure. The MEMS microphone 500 comprises a substrate 501 and a capacitor system 503 disposed on the substrate 501 and insulated from the substrate 501. The substrate 501 is made from semiconductor material, like silicon, and has a back cavity 502, an upper surface, a lower surface opposite to the upper surface and an insulating layer 512 covered on the upper surface. The back cavity 502 can be formed in the substrate 501 by dry etching or bulk silicon processing. The back cavity 502 drills through the substrate 501 and the insulating layer 512.

The capacitor system 503 comprises a first back plate 505, a second back plate 506 separated from the first back plate 505 and a diaphragm 504 disposed between the first back plate 505 and the second back plate 506. The first back plate 505 has several first through holes 516 extending through the first back plate 505, and the second back plate 506 has several second through holes 514 extending through the second back plate 506 for leaking the sound pressure. The capacitor system 503 further comprises an insulating portion. The insulating portion comprises a first insulating portion 507 sandwiched between the first back plate 505 and the diaphragm 504 thereby forming a first insulating space 508, and a second insulating portion 515 sandwiched between the second back plate 506 and the diaphragm 504 thereby forming a second insulating space 509. The MEMS microphone 500 further has an insulating support 510 connected with the diaphragm 504 arranged in the insulating space 508. The insulating support 510 crosses the geometric center of the diaphragm 504. Optionally, the insulating support 510 may also be disposed in the second insulating space 509 and connected with the diaphragm 504 or the second back plate 506. Or, the insulating supports may be both provided in the first insulating space and in the second insulating space, the insulating supports connect with the diaphragm and/or the back plate.

When the MEMS microphone 500 is working, the diaphragm 504 and the first back plate 505, and the diaphragm 504 and the second back plate 506 will take opposite charges. When the diaphragm 504 is vibrating, the diaphragm 504 will move towards the first back plate 505 under the action of the electrostatic force until the insulating support 510 engages with the first back plate 505 thereby dividing the diaphragm 504 into two vibrating units. The two vibrating units form two capacitors with the first back plate 505 and form another two capacitors with the second back plate 506. Thus, the sensitivity of the MEMS microphone 500 is improved. In this embodiment, the first back plate 505 and the second back plate 506 all have electrodes on the area marked C1 and C2 and the diaphragm 504 could have only one electrode or have two electrodes on the area marked C1 and C2.

Furthermore, the first back plate 505 may have several insulating protrusions 511 disposed on the surface towards the first insulating space 508, and the second back plate 506 could also have several insulating protrusions 511 on the surface towards the second insulating space 509 for preventing the diaphragm 504 from adhering to the first back plate 505 or the second back plate 506 while it is vibrating. The first back plate 505 further has a fitting portion 513 on the surface towards the first insulating space 508. The fitting portion 513 forms a fitting space for receiving the insulating support 510 when the insulating support 510 engages with the first back plate 505. The fitting portion 513 could be two parallel plate units or an annular unit. It should be understood that the width of the fitting space could be slightly wider than that of the insulating support 510. The fitting space formed by the fitting portion 513 is capable of ensuring the stability of the insulating support 510.

Figure 9:
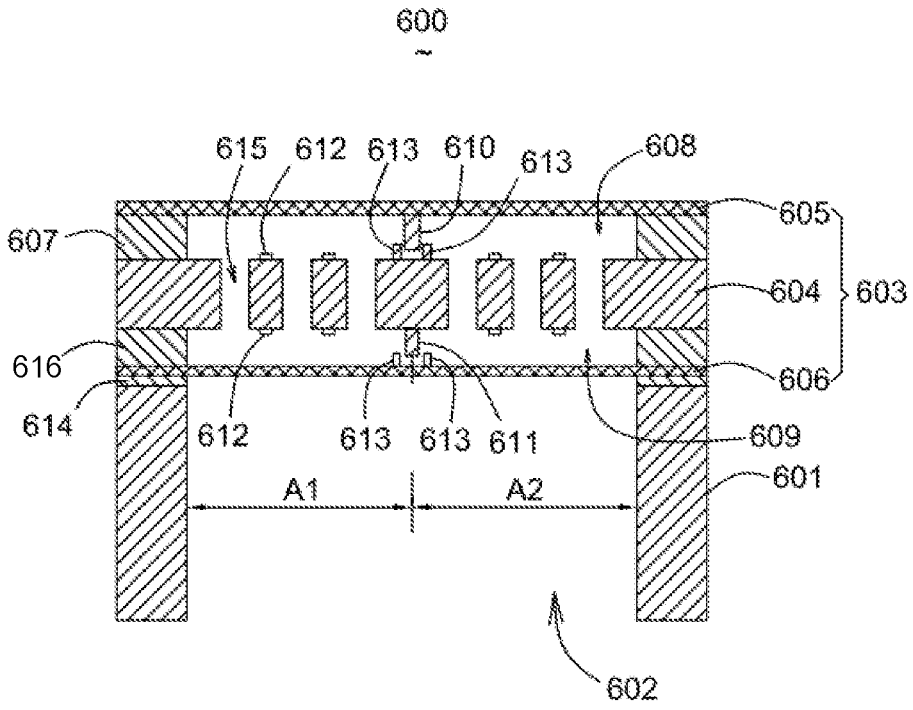
FIG. 9 is a cross-sectional view of a MEMS microphone in accordance with a sixth embodiment of the present disclosure.

FIG. 9 shows a MEMS microphone 600 in according with a sixth embodiment of the present disclosure. The MEMS microphone 600 comprises a substrate 601 having a back cavity 602 and a capacitor system 603 disposed on the substrate 601 and insulated from the substrate 601. The capacitor system 603 has a first diaphragm 605, a second diaphragm 606 separated from the first diaphragm 605 and a back plate 604 disposed between the first diaphragm 605 and the second diaphragm 606. The capacitor system 603 further comprises an insulating part. The insulating portion comprises a first insulating portion 607 sandwiched between the first diaphragm 605 and the back plate 604 thereby forming a first insulating space 608, and a second insulating portion 616 sandwiched between the second diaphragm 606 and the back plate 604 thereby forming a second insulating space 609. The back plate 604 has several through holes 615 communicating with the first insulating space 608 and the second insulating space 609. The MEMS microphone 600 further has a first insulating support 610 disposed on the surface of the first diaphragm 605 towards the first insulating support 608 and a second insulating support 611 disposed on the surface of the back plate 604 towards the second insulating space 609. Optionally, the second insulating support 608 also could connect with the surface of the second diaphragm towards the second insulating space 609.

When the MEMS microphone 600 is working, the first diaphragm 605 and the back plate 604, and the second diaphragm 606 and the back plate 604 will take opposite charges. When the first diaphragm 605 and the second diaphragm 606 are vibrating, the first diaphragm 605 and the second diaphragm 606 will move towards the back plate 604 until the first insulating support 610 engages with the back plate 604 and the second insulating support 611 engages with the second diaphragm 606. Thereby, the first diaphragm 605 is divided into two vibrating units, and the two vibrating units form two capacitors with the back plate 604. The second diaphragm 606 is divided into two vibrating units, and the two vibrating units form another two capacitors with the back plate 604. Thus, the sensitivity of the MEMS microphone 600 is improved. In this embodiment, the back plate 604 has electrode respectively on the area marked A1 and A2, and the first diaphragm 605 and the second diaphragm 606 could have only one electrode.

Furthermore, the back plate 604 could have several insulating protrusions 612 respectively on the surface towards the first insulating space 608 and on the surface towards the second insulating space 609 for preventing the first diaphragm 605 and the second diaphragm 606 from adhering to the back plate 604. Meanwhile, a fitting portion 613 is disposed on the surface of the back plate 604 towards the first insulating space 608 and on the surface of the second diaphragm 606 towards the second insulating space 609. The fitting portion 613 forms a fitting space for receiving the first insulating support 610 and the second insulating support 611 when the first insulating support 610 engages with the back plate 604 and the second insulating support 611 engages with the second diaphragm 606. The fitting portion 613 could be two parallel plate units or an annular unit. It should be understood that the width of the fitting space could be slightly wider than that of the first insulating support 610 and the second insulating support 611.

When the MEMS microphone is working, the insulating support engages with the back plate or the diaphragm thereby dividing the diaphragm into at least two vibrating units which improves the sensitivity and SNR of the MEMS microphone and makes the fabricating of the diaphragm and back plate having large area be possible. Meanwhile, the MEMS microphone has the advantage of low cost and is easy to be fabricated.

While the present disclosure has been described with reference to the specific embodiments, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. A MEMS microphone, comprising:

a substrate having a back cavity;

a capacitor system disposed on the substrate and insulated from the substrate, comprising a back plate, a diaphragm and an insulating portion sandwiched between the back plate and the diaphragm thereby separating the diaphragm from the back plate for forming an insulating space; and at least one insulating support disposed in the insulating space and connected with the diaphragm or the substrate;

wherein when the MEMS microphone is not working, the at least one insulating support separates from the back plate or the diaphragm, and when the MEMS microphone is working, the at least one insulating support engages with the back plate or the diaphragm thereby dividing the diaphragm into at least two vibrating units which form at least two independently working capacitors together with the back plate, and the MEMS microphone is thereby divided into at least two independently working microphone units;

wherein the diaphragm is one integral diaphragm for all of the independently working capacitors;

the back plate comprises a fitting portion on the surface towards the insulating space and a fitting space formed by the fitting portion for receiving the insulating support when the insulating support engages with the back plate.

2. The MEMS microphone as described in claim 1, wherein the back plate comprises a first back plate and a second back plate separated from the first back plate, the diaphragm is disposed between the first back plate and the second back plate, the insulating portion comprises a first insulating portion sandwiched between the first back plate and diaphragm thereby forming a first insulating space, and a second insulating portion sandwiched between the second back plate and the diaphragm thereby forming a second insulating space, the at least one insulating support is disposed in the first insulating space or the second insulating space, and the at least one insulating support connects with the diaphragm or the back plate.

3. The MEMS microphone as described in claim 1, wherein the diaphragm comprises a first diaphragm and a second diaphragm separated from the first diaphragm, the back plate is disposed between the first diaphragm and the second diaphragm, the insulating portion comprises a first insulating portion sandwiched between the first diaphragm and the back plate thereby forming a first insulating space, and a second insulating portion sandwiched between the second diaphragm and the back plate thereby forming a second insulating space, the insulating support comprises a first insulating support disposed in the first insulating space and connects with the first diaphragm or the back plate, and a second insulating support disposed in the second insulating space and connects with the second diaphragm or the back plate.

4. The MEMS microphone as described in claim 1, wherein the amount of the insulating support is two, the two insulating supports are perpendicular to each other and cross the geometric center of the diaphragm.

5. The MEMS microphone as described in claim 1, wherein the back plate or the diaphragm comprises several insulating protrusions positioned on the surface towards the insulating space for preventing the diaphragm from sticking to the back plate.

6. The MEMS microphone as described in claim 1, wherein the substrate comprises an upper surface, a lower surface opposite to the upper surface and an insulating layer covered on the upper surface, the back cavity drills through the insulating layer, the upper surface and the lower surface, the capacitor system is disposed on the insulating layer.

7. The MEMS microphone as described in claim 6, wherein the back plate is disposed on the insulating layer and has a first surface engaging with the insulating layer and a second surface opposite to the first surface, the insulating portion is disposed on the second surface and the diaphragm is disposed on the insulating portion.

8. The MEMS microphone as described in claim 6, wherein the diaphragm is disposed on the insulating layer and has a bottom surface engaging with the insulating layer and a top surface opposite to the bottom surface, the insulating portion is disposed on the top surface and the back plate is disposed on the insulating portion.

9. A MEMS microphone, comprising:

a conductive substrate having a back cavity;

a diaphragm separated from the conductive substrate thereby forming an insulating space;

wherein, the MEMS microphone further comprises an insulating support disposed in the insulating space and connected with the conductive substrate or the diaphragm, when the MEMS microphone is not working, the insulating support separates from the diaphragm or the conductive substrate, and when the MEMS microphone is working, the insulating support engages with the diaphragm or the conductive substrate thereby dividing the diaphragm into at least two vibrating units which form at least two independently working capacitors together with the conductive substrate, and the MEMS microphone is thereby divided into at least two independently working microphone units;

wherein the diaphragm is one integral diaphragm for all of the independently working capacitors;

the conductive substrate comprises a fitting portion on the surface towards the insulating space and a fitting space formed by the fitting portion for receiving the insulating support when the insulating support engages with the conductive substrate.

10. The MEMS microphone as described in claim 9, wherein the conductive substrate or the diaphragm has several insulating protrusions on the surface towards the insulating space for preventing the diaphragm from adhering to the conductive substrate when the diaphragm is vibrating.

11. The MEMS microphone as described in claim 1, wherein the at least two capacitors are arranged in parallel.

12. The MEMS microphone as described in claim 1, wherein the substrate includes a first inner wall and a second inner wall opposite to each other, and a third inner wall and a fourth inner wall opposite to each other; a projection of the at least one insulating support on the substrate extends from the first inner wall to the second inner wall, and/or extends from the third inner wall and to the fourth inner wall.

* * * * *